US010980281B2

(12) United States Patent
Qiu et al.

(10) Patent No.: US 10,980,281 B2
(45) Date of Patent: Apr. 20, 2021

(54) MOUTHPIECE ASSEMBLY, ATOMIZER AND ELECTRONIC CIGARETTE

(71) Applicant: Changzhou Patent Electronic Technology Co., LTD, Jiangsu (CN)

(72) Inventors: Weihua Qiu, Jiangsu (CN); Neng Hua, Jiangsu (CN)

(73) Assignee: Changzhou Patent Electronic Technology Co., LTD, Jiangsu (CN)

( * ) Notice: Subject to any disclaimer, the term of this patent is extended or adjusted under 35 U.S.C. 154(b) by 291 days.

(21) Appl. No.: 16/241,533

(22) Filed: Jan. 7, 2019

(65) Prior Publication Data

US 2019/0208817 A1 Jul. 11, 2019

(30) Foreign Application Priority Data

Jan. 5, 2018 (CN) ..... 201820023685.5

(51) Int. Cl.
*A24F 47/00* (2020.01)

(52) U.S. Cl.
CPC ..... *A24F 47/008* (2013.01)

(58) Field of Classification Search
CPC ..... A24F 47/008
USPC ..... 131/329
See application file for complete search history.

(56) References Cited

U.S. PATENT DOCUMENTS 3,774,624 A * 11/1973 Fassbender ..... A24F 1/00 131/201
9,016,274 B1 * 4/2015 White ..... A61M 15/06 128/202.21
2012/0097660 A1 * 4/2012 Bao ..... B05B 1/24 219/209
2013/0319438 A1 * 12/2013 Liu ..... A24F 47/008 131/329
2019/0150512 A1 * 5/2019 Furudono ..... A24F 40/42
2019/0208817 A1 * 7/2019 Qiu ..... A24F 47/008

* cited by examiner

*Primary Examiner* — Neil Abrams
(74) *Attorney, Agent, or Firm* — Novick, Kim & Lee, PLLC; Allen Xue

(57) ABSTRACT

A mouthpiece assembly includes a mouthpiece body, a mouthpiece connected to the mouthpiece body, and a heat dissipation member located in the mouthpiece body, the mouthpiece body is provided with an airflow passage in communication with the mouthpiece, and at least one heat dissipation hole, the air flow passage is at least partially formed by the inner cavity of the heat dissipation member, the outer wall of the heat dissipation member is at least partially in communication with the outside through the heat dissipation hole, smoke flows out through the air flow passage and the mouthpiece. In the present disclosure, when the smoke in the airflow passage flows through the heat dissipation member, part of the heat in the smoke can be transmitted to the heat dissipation member and then dissipated into the outside air through the heat dissipation hole, thereby cooling the smoke flowing through the heat dissipation member.

20 Claims, 5 Drawing Sheets

MOUTHPIECE ASSEMBLY, ATOMIZER AND ELECTRONIC CIGARETTE

FIELD

The present disclosure relates to an electronic cigarette technical field, and particularly relates to a mouthpiece assembly, an atomizer and an electronic cigarette using the same.

BACKGROUND

The electronic cigarette generally includes a mouthpiece assembly, an atomizing device, and a power supply device. In use, the aerosol-forming substrate (for example, smoke liquid, smoke paste, shredded tobacco, etc.) in the atomizing device is heated and generates smoke electric driven by the power supply device. The user inhales the smoke through the mouthpiece assembly. However, if the temperature of the smoke entering the user's mouth is high, it may cause the user to burn, which reduces the user's experience.

SUMMARY

According to the above technical problem, it is necessary to provide a mouthpiece assembly capable of cooling the smoke entering the user's mouth;

It is also to provide an electronic cigarette with the atomizer.

It is further to provide an electronic cigarette with the atomizer.

A mouthpiece assembly includes a mouthpiece body, a mouthpiece connected to the mouthpiece body, and a heat dissipation member located in the mouthpiece body, the mouthpiece body is provided with an airflow passage in communication with the mouthpiece, and at least one heat dissipation hole, the air flow passage is at least partially formed by the inner cavity of the heat dissipation member, the outer wall of the heat dissipation member is at least partially in communication with the outside through the heat dissipation hole, smoke flows out through the air flow passage and the mouthpiece.

In one embodiment, the heat dissipation member 102 includes a heat dissipation body corresponding the heat dissipation hole, the air flow passage includes the inner chamber of the heat dissipation body.

In one embodiment, the heat dissipation member further includes at least one heat sink located at the outer wall thereof, the number of the heat sinks is the same as the number of the heat dissipation holes, the heat dissipation member and the heat dissipation hole are one-to-one arranged.

In one embodiment, the mouthpiece body comprises a mouthpiece base and a mouthpiece upper cover, the mouthpiece is mounted on the mouthpiece upper cover, one end of the mouthpiece upper cover away from the mouthpiece is connected to the mouthpiece base, the heat dissipation member is located on the mouthpiece base, the heat dissipation hole is defined on the mouthpiece upper cover.

In one embodiment, the mouthpiece assembly further comprises a connecting member, the connecting member extends through the mouthpiece base and then is connected to the mouthpiece upper cover, the connecting member is provided with a smoke outlet hole along the axial direction thereof, a second venting portion communicating with the inner cavity of the heat dissipating member is disposed on a sidewall of the communicating member along the radial direction of the communicating member, the vent hole is in communication with the mouthpiece and the second venting portion, the air flow passage further comprises the smoke outlet and the second vent.

In one embodiment, a gap is formed between the mouthpiece base and the mouthpiece upper cover, a venting member is installed in the gap, the venting member defines a ventilation groove, the heat dissipation member is provided with a second ventilation portion in communication with the first ventilation portion, the opposite ends of the ventilation groove is in communication with the first ventilation portions and the second ventilation portion.

In one embodiment, the mouthpiece upper cover defines a receiving groove, one end of the mouthpiece is rotatably mounted in the accommodating groove, the mouthpiece defines an outlet groove, when the mouthpiece is rotated to the accommodating position, the mouthpiece is received in the accommodating groove; when the smoke outlet is staggered from the smoke outlet, the opposite end of the mouthpiece is separated from the receiving groove; when the mouthpiece is rotated to the sucking position, the smoke outlet is in communication with the smoke outlet.

In one embodiment, the heat dissipation hole is defined at the bottom of the accommodating groove, the mouthpiece shields at least a portion of the heat dissipation hole when the mouthpiece is in the accommodating position.

An atomizer includes an atomizing device and any one of the above mouthpiece assembly.

In one embodiment, the heat dissipation member 102 includes a heat dissipation body corresponding the heat dissipation hole, the air flow passage includes the inner chamber of the heat dissipation body.

In one embodiment, the heat dissipation member further includes at least one heat sink located at the outer wall thereof, the number of the heat sinks is the same as the number of the heat dissipation holes, the heat dissipation member and the heat dissipation hole are one-to-one arranged.

In one embodiment, the mouthpiece body comprises a mouthpiece base and a mouthpiece upper cover, the mouthpiece is mounted on the mouthpiece upper cover, one end of the mouthpiece upper cover away from the mouthpiece is connected to the mouthpiece base, the heat dissipation member is located on the mouthpiece base, the heat dissipation hole is defined on the mouthpiece upper cover.

In one embodiment, the mouthpiece assembly further comprises a connecting member, the connecting member extends through the mouthpiece base and then is connected to the mouthpiece upper cover, the connecting member is provided with a smoke outlet hole along the axial direction thereof, a second venting portion communicating with the inner cavity of the heat dissipating member is disposed on a sidewall of the communicating member along the radial direction of the communicating member, the vent hole is in communication with the mouthpiece and the second venting portion, the air flow passage further comprises the smoke outlet and the second vent.

In one embodiment, a gap is formed between the mouthpiece base and the mouthpiece upper cover, a venting member is installed in the gap, the venting member defines a ventilation groove, the heat dissipation member is provided with a second ventilation portion in communication with the first ventilation portion, the opposite ends of the ventilation groove is in communication with the first ventilation portions and the second ventilation portion.

An electronic cigarette, includes a power supply device and any one of the above atomizer In one embodiment, the heat dissipation member 102 includes a heat dissipation body corresponding the heat dissipation hole, the air flow passage includes the inner chamber of the heat dissipation body.

In one embodiment, the heat dissipation member further includes at least one heat sink located at the outer wall thereof, the number of the heat sinks is the same as the number of the heat dissipation holes, the heat dissipation member and the heat dissipation hole are one-to-one arranged.

In one embodiment, the mouthpiece body comprises a mouthpiece base and a mouthpiece upper cover, the mouthpiece is mounted on the mouthpiece upper cover, one end of the mouthpiece upper cover away from the mouthpiece is connected to the mouthpiece base, the heat dissipation member is located on the mouthpiece base, the heat dissipation hole is defined on the mouthpiece upper cover.

In one embodiment, the mouthpiece assembly further comprises a connecting member, the connecting member extends through the mouthpiece base and then is connected to the mouthpiece upper cover, the connecting member is provided with a smoke outlet hole along the axial direction thereof, a second venting portion communicating with the inner cavity of the heat dissipating member is disposed on a sidewall of the communicating member along the radial direction of the communicating member, the vent hole is in communication with the mouthpiece and the second venting portion, the air flow passage further comprises the smoke outlet and the second vent.

In one embodiment, a gap is formed between the mouthpiece base and the mouthpiece upper cover, a venting member is installed in the gap, the venting member defines a ventilation groove, the heat dissipation member is provided with a second ventilation portion in communication with the first ventilation portion, the opposite ends of the ventilation groove is in communication with the first ventilation portions and the second ventilation portion.

The beneficial effects of the device are:

In the present disclosure, when the smoke in the airflow passage flows through the heat dissipation member, part of heat in the smoke can be transmitted to the heat dissipation member and then dissipated into the outside air through the heat dissipation hole, thereby cooling the smoke flowing through the heat dissipation member, and reducing the temperature of the smoke entering the mouth of the user through the mouthpiece, preventing the situation of scalding the user due to excessively high temperature of the smoke.

Figure 1:
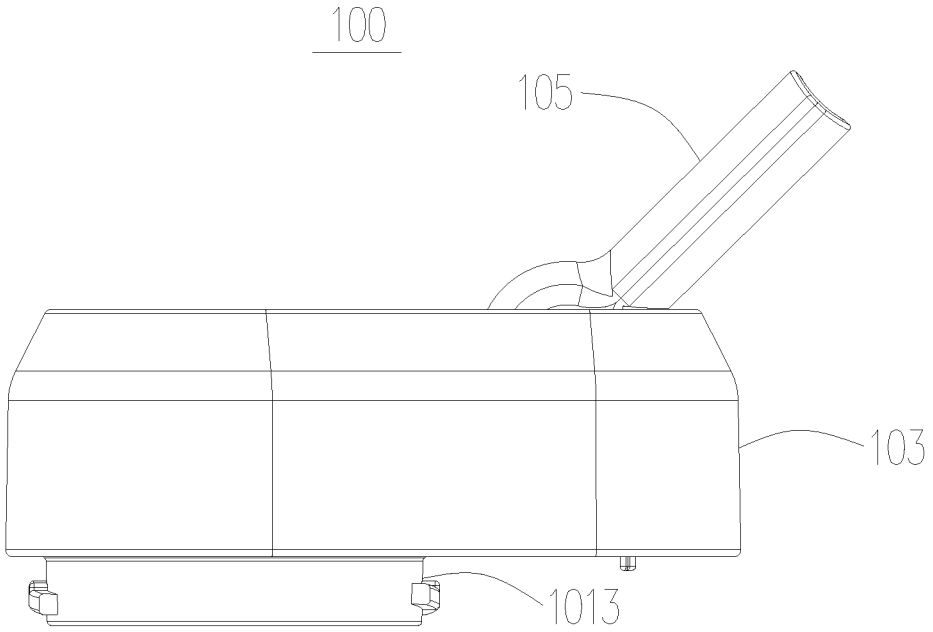
FIG. 1 is a schematic view of a mouthpiece assembly of the present discourse.

The following table list various components and reference numerals thereof.

| | |
|---|---|
| Mouthpiece assembly 100 | Connecting member 104 |
| Mouthpiece base 101 | Smoke outlet 1041 |

-continued

| | |
|---|---|
| First mounting hole 1011 | Second ventilation portion 1042 |
| Through hole 1012 | Disassembly unit 1043 |
| Connection portion 1013 | Arcuate groove 1044 |
| heat dissipation member 102 | Mouthpiece 105 |
| First vent 1021 | Suction unit 1051 |
| Filter 1022 | Rotation part 1052 |
| heat sink 1023 | First smoke outlet groove 1053 |
| Mouthpiece upper cover 103 | Second smoke outlet groove 1054 |
| Second mounting hole 1031 | Venting member 106 |
| Receiving groove 1032 | Ventilation groove 1061 |
| Heat dissipation hole 1033 | |

DETAILED DESCRIPTION OF PREFERRED EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/".

Please refer to FIG. 1, the present disclosure provides an electronic cigarette, which includes an atomizer and a power supply device (not shown) electrically connected to the atomizer. The atomizer includes an atomizing device (not shown) and a mouthpiece assembly 100 connected to the atomizing device. In particular, the power supply device is electrically coupled to the atomizing device. In use, the aerosol-forming substrate (e.g., cigarette liquid, tobacco paste, tobacco leaf, tobacco shred, etc.) is heated to generate smoke by the atomizing device electric which is driven by the power supply device, thus the user can inhale the smoke through the mouthpiece assembly 100.

Figure 2:
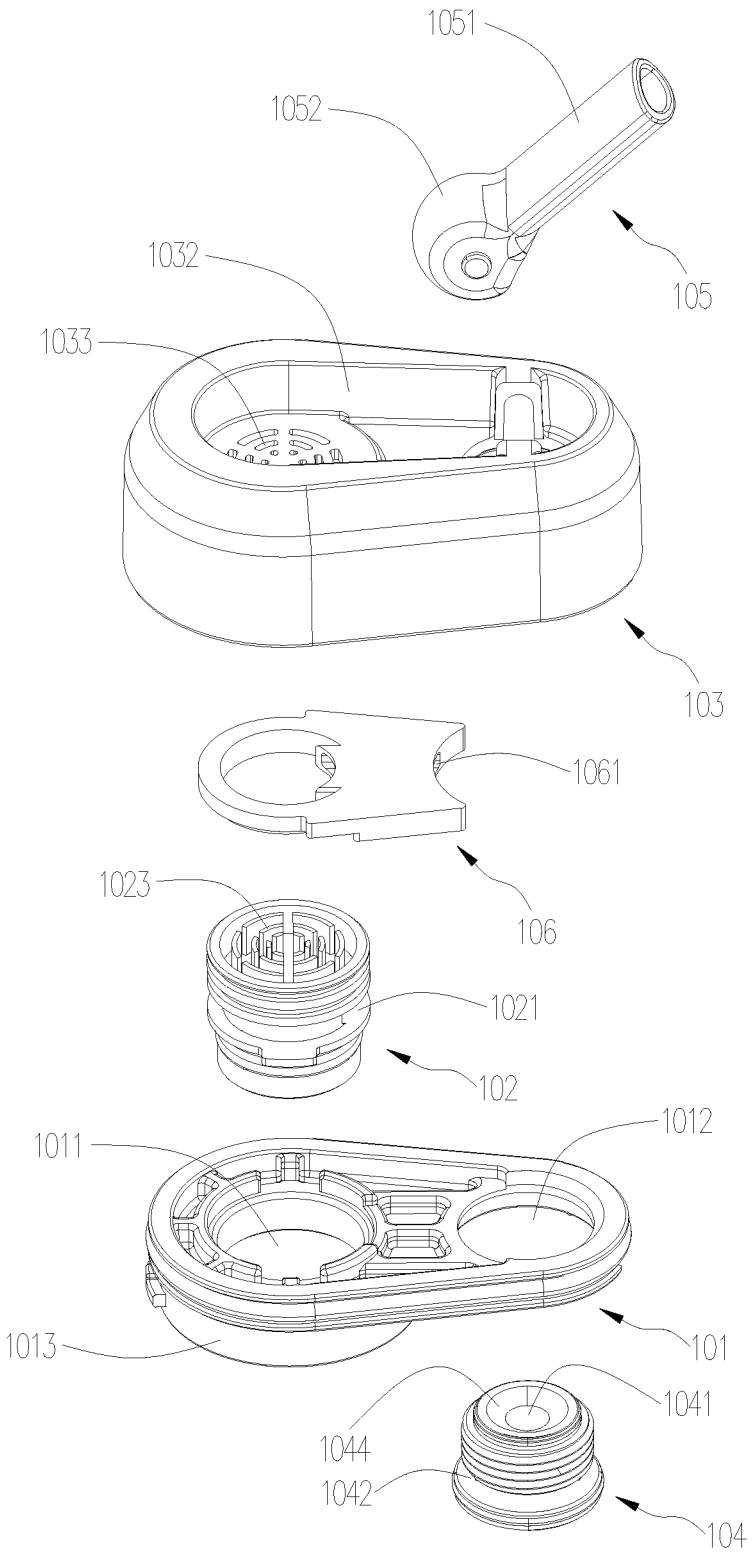
FIG. 2 is an exploded view of the mouthpiece assembly of FIG. 1.
Figure 5:
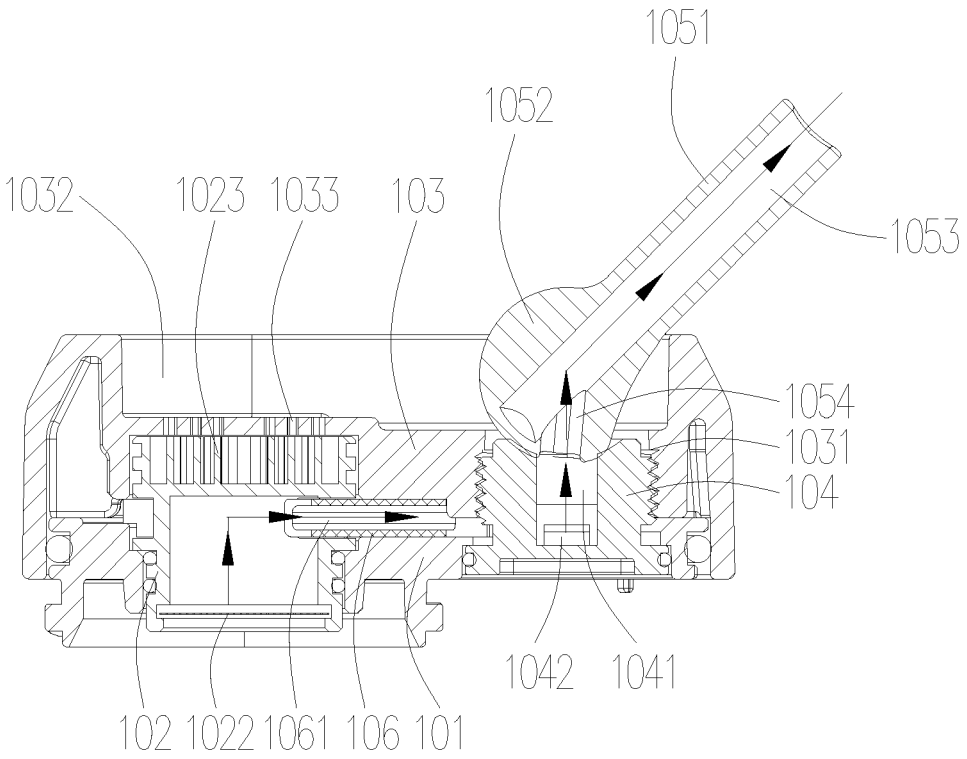
FIG. 5 is a cross-sectional view of the mouthpiece assembly of FIG. 1.

Please refer to FIG. 2 and FIG. 5, the mouthpiece assembly 100 includes a mouthpiece base 101, a heat dissipation member 102, a mouthpiece upper cover 103, a connecting member 104, and a mouthpiece 105. The mouthpiece upper cover 103 is mounted on the upper end of the mouthpiece base 101 through the connecting member 104. The heat dissipation member 102 is located on the mouthpiece base 101 and is received in a chamber formed by the mouthpiece base 101 and the mouthpiece upper cover 103. The mouthpiece 105 is mounted on the mouthpiece upper cover 103, the mouthpiece 105 is in communication with the heat dissipation member 102, the user inhales the smoke through the mouthpiece 105.

Specifically, the mouthpiece base 101 is substantially a disk shape. The opposite sides of the mouthpiece base 101 are respectively provided with a first mounting hole 1011 and a through hole 1012. The first mounting hole 1011 is configured for connecting the heat dissipation member 102, the connecting member 104 passes through the through hole 1012 and is connected to the mouthpiece upper cover 103. The lower end of the mouthpiece base 101 extends downward to form a connecting portion 1013 corresponding to the first mounting hole 1011, the atomizing device is connected to the mouthpiece assembly 100 through the connecting portion 1013. In this embodiment, the atomizing device is a tobacco pot (not shown) for storing and heating the aerosol-forming substrate, the connecting portion 1013 is detachably connected to the tobacco pot through clamping, magnetic connection or a screw connection.

The heat dissipation member 102 includes a heat dissipation body (not shown). The heat dissipation body has a hollow cylindrical structure with an opening at a lower end thereof. The heat dissipation body is inserted into the first mounting hole 1011. When the atomizing device is assembled with the mouthpiece assembly 100, the atomizing chamber (not shown) defined in the atomizing device is in communication with the inner cavity of the heat dissipation body. Further, the sidewall of the heat dissipation body is provided with a first ventilation portion 1021 communicating with the inner cavity of the heat dissipation body, so that the smoke generated in the atomizing chamber can be inhaled by the user after flowing out through the heat dissipating body. The opening at the lower end of the heat dissipation body is provided with a filter 1022 to prevent impurities from being mixed in the smoke and being carried out by the air flow, thereby improving the user's taste. The impurities that may be produced are different for different aerosol-forming substrates. For example, when the aerosol-forming substrate is tobacco shred, the impurities that may be generated are fine tobacco shred; and, for example, when the aerosol-forming substrate is a cigarette liquid, the impurities that may be generated are un-atomized complete cigarette liquid.

The mouthpiece upper cover 103 has a hollow box-like structure having an opening at the lower end, the upper end surface of the mouthpiece upper cover 103 is recessed downward to form a receiving groove 1032 for receiving the mouthpiece 105. The upper end surface of the mouthpiece upper cover 103 (the bottom of the receiving groove 1032) is provided with a second mounting hole 1031 corresponding to the through hole 1012, the second mounting hole 1031 is in communication with the receiving groove 1032. One end of the connecting member 104 abuts against the hole wall of the through hole 1012, the opposite end of the connecting member 104 passes through the through hole 1012 and is installed in the second mounting hole 1031, thereby connecting the mouthpiece upper cover 103 and the mouthpiece base 101 together. The mouthpiece base 101 is at least partially received in the lower end of the mouthpiece upper cover 103. The mouthpiece upper cover 103 and the mouthpiece base 101 together form the mouthpiece body (not shown). It can be understood that in other embodiments not shown, the mouthpiece body is integrally formed.

The connecting member 104 has a substantially cylindrical structure. The upper end of the connecting member 104 is provided with a smoke outlet 1041 along the axial direction of the communication member 304. A second ventilation portion 1042 is defined on the sidewall of the connecting member 104 along the radial direction of the connecting member 104 and is in communication with the smoke outlet 1041. In the embodiment, the connecting member 104 is screwed to the second mounting hole 1031.

It should be noted that, when the mouthpiece base 101 and the mouthpiece upper cover 103 are installed in position, a gap (not shown) is formed between the mouthpiece base 101 and the mouthpiece upper cover 103. The gap is in communication with the first ventilation portion 1021 and the second ventilation portion 1042, such that smoke generated in the atomizing device can enter the connecting member 104 via the heat dissipation member 102. In order to enhance the airtightness of the airflow passage, through which the airflow flows from the heat dissipation body of the heat dissipation member 102 to the connecting member 104, a venting member 106 is sleeved outer of the heat dissipating body. One side of the venting member 106 extends to contact with the connecting member 104. The venting member 106 is provided in a ventilating groove 1061. One end of the ventilation groove 1061 is in communication with the first ventilation portion 1021, the opposite end of the ventilation groove 1061 is in communication with the second ventilation portion 1042 to realize airflow. It will be understood that, the venting member 106 can be made of sealing material, such as silicone or rubber.

Figure 4:
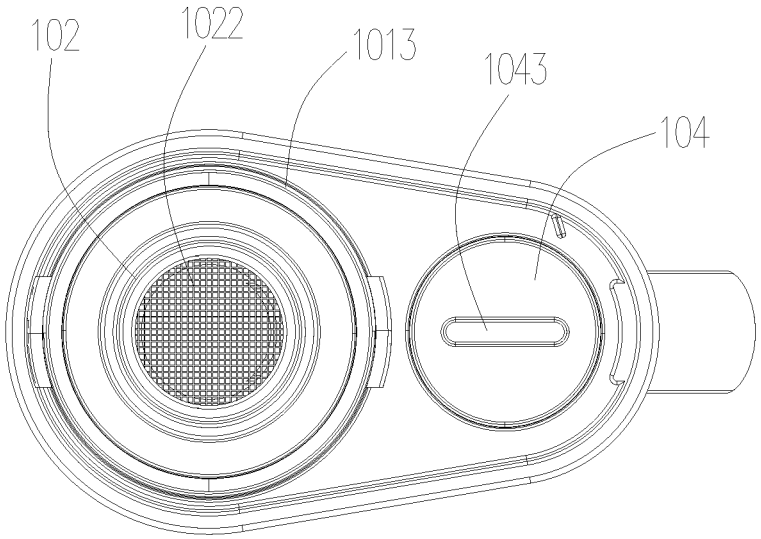
FIG. 4 is a bottom view of the mouthpiece assembly of FIG. 1.

Referring to FIG. 4 together, in order to facilitate the disassembly and assembly of the connecting member 104, the lower end of the connecting member 104 is further provided with a dismounting portion 1043. In the embodiment, the dismounting portion 1043 is a groove formed on the lower surface of the connecting member 104. During the disassembly process, a coin, a metal sheet or the like can be directly placed in the groove, so that the connecting member 104 can be unscrewed, and then, the mouthpiece assembly 100 can be integrally removed to facilitate cleaning and replacement of components. In addition, since one-dollar coins, metal sheets, and the like are relatively common, the user does not need to purchase an additional disassembly tool.

In the embodiment, the upper end of the connecting member 104 is further provided with an arcuate groove 1044 that is in communication with the smoke outlet 1041.

Referring to FIG. 5, the mouthpiece 105 includes a suction portion 1051 and a rotating portion 1052 disposed at one end of the suction portion 1051. The mouthpiece 105 is provided with a smoke outlet groove in communication with the suction portion 1051 and the rotating portion 1052 (not shown). The outlet groove includes a first smoke outlet groove 1053 which is defined in the axial direction of the suction portion 1051, and a second outlet groove 1054 which is disposed on the rotating portion 1052 and in communication with the first smoke outlet groove 1053.

The rotating portion 1052 is rotatably mounted in an end of the receiving groove 1032 adjacent to the second mounting hole 1031. At least part of the outer surface of the rotating portion 1052 is a circular arc surface (not shown), the second smoke outlet groove 1054 extends through the circular arc surface, the circular arc surface is engaged with the groove wall of the arcuate groove 1044 of the connecting member 104. During the rotation of the mouthpiece 105, the circular arc surface of the rotating portion 1052 is always in close contact with the groove wall of the arcuate groove 1044. When the mouthpiece 105 is rotated to the mouthpiece 105 to be completely received in the receiving groove 1032 (that is, when the mouthpiece 105 is in the accommodating position), the second smoke outlet groove 1054 is staggered from the smoke outlet 1041 of the connecting member 104. When the mouthpiece 105 is rotated until it is blocked by the side wall of the receiving groove 1032 close to the second mounting hole 1031 and cannot be rotated (that is, when the mouthpiece 105 is in the suction position), the second smoke outlet groove 1054 is in communication with the smoke outlet 1041 in position, such that the user can inhale the smoke. It can be understood that, when the electronic cigarette is not use, the mouthpiece 105 can be received in the receiving groove 1032, thereby the overall volume of the electronic cigarette can be reduced, which is convenient for carrying and transportation.

In this embodiment, the inner cavity of the heat dissipation body, the first ventilation portion 1021, the ventilation groove 1061, the second ventilation portion 1042, and the smoke outlet 1041 are together to form an air flow passage in communication between the atomization chamber and the mouthpiece 105 (not shown). When the user inhales, due to the negative pressure, the smoke in the atomization chamber enters the mouthpiece 105 via the airflow passage, and then flow out to the user's mouth. The direction indicated by the arrow in FIG. 5 is the flow direction of the smoke.

Figure 3:
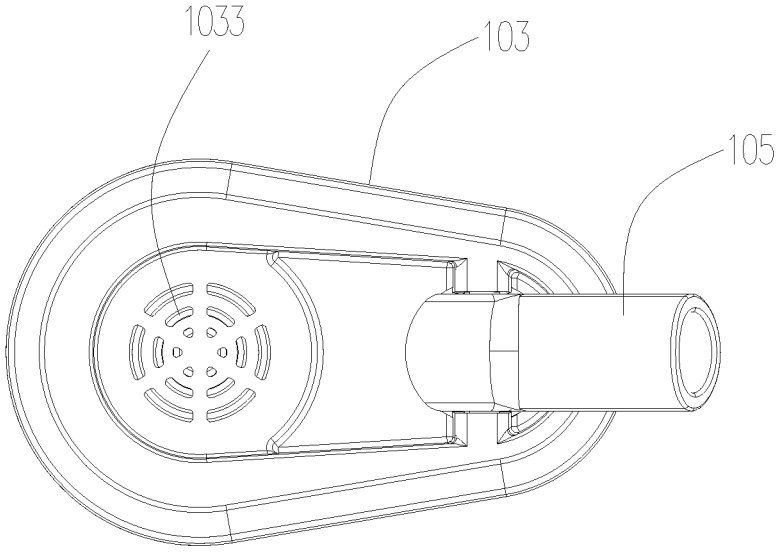
FIG. 3 is a top view of the mouthpiece assembly of FIG. 1.

Referring to FIG. 3 and FIG. 5, in the embodiment, in order to reduce the temperature of the airflow in the airflow passage, the bottom of the receiving groove 1032 is provided with a heat dissipation hole 1033 corresponding to the heat dissipation body, the heat dissipation hole 1033 is in communication with the outside air. When the smoke flows through the heat dissipation member 102, the heat of the smoke can be partially transmitted to the heat dissipation body, and finally dissipated into the outside air through the heat dissipation hole 1033, thereby cooling the smoke in the air flow passage and preventing the user from scalding due to the temperature of the smoke entering the user's mouth is too high. It can be understood that, when the mouthpiece 105 is in the accommodating position, the mouthpiece 105 can shield at least a part of the heat dissipation hole 1033, thereby preventing the dust in the air from falling into the heat dissipation hole 1033 and blocking the heat dissipation hole 1033, thereby reducing the heat dissipation efficiency.

In addition, referring to FIG. 2 and FIG. 5, the heat dissipation member 102 further includes at least one heat sink 1023 protruding from the top of the heat dissipating body. When the smoke in the airflow passage passes through the heat dissipating body, the heat conducted to the top of the heat dissipating body can be transmitted to the heat dissipating body. The heat sink 1023 further increases the heat dissipation area of the heat dissipation member 102, so that the heat dissipation member 102 can conduct more heat per unit time, thereby improving the cooling effect on the smoke in the air flow passage. The number of the heat sinks 1023 is the same as the number of the heat dissipation holes 1033, and the two are one-to-one arranged, so that the heat on the heat sink 1023 is directly transmitted to the outside through the corresponding heat dissipation holes 1033, avoiding the reduction of the heat dissipation effect due to the blocking effect of the bottom of the receiving groove 1032. It can be understood that, the more the number of the heat sinks 1023, the larger the heat dissipation area of the heat dissipation member 102, and the better the cooling effect on the smoke in the airflow passage.

The heat dissipating member 102 is made of heat conductive material. In the embodiment, the material of the heat dissipating member 102 is aluminum. The aluminum is light in weight and high in heat conduction efficiency, thereby, the weight of the electronic cigarette is reduced while the effect of cooling the smoke is good. It can be understood that, in other embodiments not shown, the heat dissipation member 102 can also be made of metal heat conductive material such as silver or copper, or made of non-metal heat conductive material such as graphite or silicon, which is not limited herein.

It can be understood that, in other embodiments not shown, the heat dissipation hole 1033 can also be formed on the sidewall of the mouthpiece upper cover 103 or the sidewall of the mouthpiece base 101, the heat sink 1023 is disposed on the sidewall of the heat dissipation body corresponding to the heat dissipation hole 1033. That is, only the heat on the heat sink 1023 can be dissipated into the outside through the heat dissipation hole 1033 via the mouthpiece body, the arrangement positions of the heat dissipation hole 1033 and the heat sink 1023 are not limited.

In the mouthpiece assembly 100 of the present disclosure, when the smoke in the airflow passage flows through the heat dissipation member 102, part of heat in the smoke can be transmitted to the heat dissipation member 102 and then dissipated into the outside air through the heat dissipation hole 1033, thereby cooling the smoke flowing through the heat dissipation member 102, and reducing the temperature of the smoke entering the mouth of the user through the mouthpiece 105, preventing the situation of scalding the user due to excessively high temperature of the smoke.

The atomizer and the electronic cigarette provided by the present disclosure have the same technical effects as the above-described mouthpiece assembly 100 because they have all the technical features of the above-described mouthpiece assembly 100.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. A mouthpiece assembly, comprising:

a mouthpiece body;

a mouthpiece connected to the mouthpiece body, the mouthpiece body is provided with an airflow passage in communication with the mouthpiece, and at least one heat dissipation hole; and a heat dissipation member located in the mouthpiece body, the air flow passage is at least partially formed by the inner cavity of the heat dissipation member, the outer wall of the heat dissipation member is at least partially in communication with the outside through the heat dissipation hole, smoke flows out through the air flow passage and the mouthpiece.

2. The mouthpiece assembly of claim 1, wherein the heat dissipation member comprises a heat dissipation body corresponding the heat dissipation hole, the air flow passage comprises the inner chamber of the heat dissipation body.

3. The mouthpiece assembly of claim 2, wherein the heat dissipation member further comprises at least one heat sink located at the outer wall thereof, the number of the heat sinks is the same as the number of the heat dissipation holes, the heat dissipation members and the heat dissipation holes are one-to-one arranged.

4. The mouthpiece assembly of claim 1, wherein the mouthpiece body comprises a mouthpiece base and a mouthpiece upper cover, the mouthpiece is mounted on the mouthpiece upper cover, one end of the mouthpiece upper cover away from the mouthpiece is connected to the mouthpiece base, the heat dissipation member is located on the mouthpiece base, the heat dissipation hole is defined on the mouthpiece upper cover.

5. The mouthpiece assembly of claim 1, wherein the mouthpiece assembly further comprises a connecting member, the connecting member extends through the mouthpiece base and then is connected to the mouthpiece upper cover, the connecting member is provided with a smoke outlet hole along the axial direction thereof, a second venting portion communicating with the inner cavity of the heat dissipating member is disposed on a sidewall of the communicating member along the radial direction of the communicating member, the vent hole is in communication with the mouthpiece and the second venting portion, the air flow passage further comprises the smoke outlet and the second vent.

6. The mouthpiece assembly of claim 5, wherein a gap is formed between the mouthpiece base and the mouthpiece upper cover, a venting member is installed in the gap, the venting member defines a ventilation groove, the heat dissipation member is provided with a second ventilation portion in communication with the first ventilation portion, the opposite ends of the ventilation groove is in communication with the first ventilation portions and the second ventilation portion.

7. The mouthpiece assembly of claim 5, wherein the mouthpiece upper cover defines a receiving groove, one end of the mouthpiece is rotatably mounted in the accommodating groove, the mouthpiece defines an outlet groove, when the mouthpiece is rotated to the accommodating position, the mouthpiece is received in the accommodating groove; when the smoke outlet is staggered from the smoke outlet, the opposite end of the mouthpiece is separated from the receiving groove; when the mouthpiece is rotated to the sucking position, the smoke outlet is in communication with the smoke outlet.

8. The mouthpiece assembly of claim 7, wherein the heat dissipation hole is defined at the bottom of the accommodating groove, the mouthpiece shields at least a portion of the heat dissipation hole when the mouthpiece is in the accommodating position.

9. An atomizer, comprising:

an atomizing device; and a mouthpiece assembly, the mouthpiece assembly comprises:

a mouthpiece body;

a mouthpiece connected to the mouthpiece body, the mouthpiece body is provided with an airflow passage in communication with the mouthpiece, and at least one heat dissipation hole; and a heat dissipation member located in the mouthpiece body, the air flow passage is at least partially formed by the inner cavity of the heat dissipation member, the outer wall of the heat dissipation member is at least partially in communication with the outside through the heat dissipation hole, smoke flows out through the air flow passage and the mouthpiece.

10. The atomizer of claim 9, wherein the heat dissipation member comprises a heat dissipation body corresponding the heat dissipation hole, the air flow passage comprises the inner chamber of the heat dissipation body.

11. The atomizer of claim 10, wherein the heat dissipation member further comprises at least one heat sink located at the outer wall thereof, the number of the heat sinks is the same as the number of the heat dissipation holes, the heat dissipation member and the heat dissipation hole are one-to-one arranged.

12. The atomizer of claim 9, wherein the mouthpiece body comprises a mouthpiece base and a mouthpiece upper cover, the mouthpiece is mounted on the mouthpiece upper cover, one end of the mouthpiece upper cover away from the mouthpiece is connected to the mouthpiece base, the heat dissipation member is located on the mouthpiece base, the heat dissipation hole is defined on the mouthpiece upper cover.

13. The atomizer of claim 12, wherein the mouthpiece assembly further comprises a connecting member, the connecting member extends through the mouthpiece base and then is connected to the mouthpiece upper cover, the connecting member is provided with a smoke outlet hole along the axial direction thereof, a second venting portion communicating with the inner cavity of the heat dissipating member is disposed on a sidewall of the communicating member along the radial direction of the communicating member, the vent hole is in communication with the mouthpiece and the second venting portion, the air flow passage further comprises the smoke outlet and the second vent.

14. The atomizer of claim 13, wherein a gap is formed between the mouthpiece base and the mouthpiece upper cover, a venting member is installed in the gap, the venting member defines a ventilation groove, the heat dissipation member is provided with a second ventilation portion in communication with the first ventilation portion, the opposite ends of the ventilation groove is in communication with the first ventilation portions and the second ventilation portion.

15. An electronic cigarette, comprising:

a power supply device; and an atomizer, the atomizer comprises an atomizing device and a mouthpiece assembly, the mouthpiece assembly comprises:

a mouthpiece body;

a mouthpiece connected to the mouthpiece body, the mouthpiece body is provided with an airflow passage in communication with the mouthpiece, and at least one heat dissipation hole; and a heat dissipation member located in the mouthpiece body, the air flow passage is at least partially formed by the inner cavity of the heat dissipation member, the outer wall of the heat dissipation member is at least partially in communication with the outside through the heat dissipation hole, smoke flows out through the air flow passage and the mouthpiece.

16. The electronic cigarette of claim 15, wherein the heat dissipation member comprises a heat dissipation body corresponding the heat dissipation hole, the air flow passage comprises the inner chamber of the heat dissipation body.

17. The electronic cigarette of claim 16, wherein the heat dissipation member further comprises at least one heat sink located at the outer wall thereof, the number of the heat sinks is the same as the number of the heat dissipation holes, the heat dissipation member and the heat dissipation hole are one-to-one arranged.

18. The electronic cigarette of claim 15, wherein the mouthpiece body comprises a mouthpiece base and a mouthpiece upper cover, the mouthpiece is mounted on the mouthpiece upper cover, one end of the mouthpiece upper cover away from the mouthpiece is connected to the mouthpiece base, the heat dissipation member is located on the mouthpiece base, the heat dissipation hole is defined on the mouthpiece upper cover.

19. The electronic cigarette of claim 18, wherein the mouthpiece assembly further comprises a connecting member, the connecting member extends through the mouthpiece base and then is connected to the mouthpiece upper cover, the connecting member is provided with a smoke outlet hole along the axial direction thereof, a second venting portion communicating with the inner cavity of the heat dissipating member is disposed on a sidewall of the communicating member along the radial direction of the communicating member, the vent hole is in communication with the mouthpiece and the second venting portion, the air flow passage further comprises the smoke outlet and the second vent.

20. The electronic cigarette of claim 19, wherein a gap is formed between the mouthpiece base and the mouthpiece upper cover, a venting member is installed in the gap, the venting member defines a ventilation groove, the heat dissipation member is provided with a second ventilation portion in communication with the first ventilation portion, the opposite ends of the ventilation groove is in communication with the first ventilation portions and the second ventilation portion.

* * * * *